US011162646B2

(12) United States Patent
Kwon

(10) Patent No.: US 11,162,646 B2
(45) Date of Patent: Nov. 2, 2021

(54) LED LIGHTING APPARATUS WITH UNIFORM-EMITTING PERFORMANCE ON WALL-STRUCTURE

(71) Applicant: Hyundai Luxon Co., Ltd., Seoul (KR)

(72) Inventor: Youn Kyung Kwon, Gyeonggi-do (KR)

(73) Assignee: Hyundai Luxon Co., Ltd., Seoul (KR)

( * ) Notice: Subject to any disclaimer, the term of this patent is extended or adjusted under 35 U.S.C. 154(b) by 0 days.

(21) Appl. No.: 17/156,094

(22) Filed: Jan. 22, 2021

(65) Prior Publication Data

US 2021/0278051 A1 Sep. 9, 2021

(30) Foreign Application Priority Data

Mar. 3, 2020 (KR) ..... 10-2020-0026417

(51) Int. Cl.

| | |
|---|---|
| ***F21K 9/69*** | (2016.01) |
| ***F21V 17/04*** | (2006.01) |
| ***F21S 8/00*** | (2006.01) |
| ***F21K 9/66*** | (2016.01) |
| ***F21V 3/06*** | (2018.01) |
| ***F21Y 115/10*** | (2016.01) |

(52) U.S. Cl.

CPC ..... *F21K 9/69* (2016.08); *F21K 9/66* (2016.08); *F21S 8/033* (2013.01); *F21V 3/0625* (2018.02); *F21V 17/04* (2013.01); *F21Y 2115/10* (2016.08)

(58) Field of Classification Search

CPC ..... F21S 8/033; F21S 8/037; F21V 3/0625; F21V 3/062

See application file for complete search history.

(56) References Cited

U.S. PATENT DOCUMENTS

| | | | | |
|---|---|---|---|---|
| 8,678,616 | B2 * | 3/2014 | Marquardt | A47F 3/001 362/235 |
| 2008/0285260 | A1 * | 11/2008 | Sherman | F21S 8/037 362/133 |
| 2008/0314944 | A1 * | 12/2008 | Tsai | F21V 21/088 224/331 |
| 2010/0135020 | A1 * | 6/2010 | Moore | A47F 11/10 362/249.02 |
| 2011/0058353 | A1 * | 3/2011 | Yang | F21V 7/0033 362/84 |

(Continued)

FOREIGN PATENT DOCUMENTS

KR 1020130054694 A 5/2013

*Primary Examiner* — William N Harris

(74) *Attorney, Agent, or Firm* — Rabin & Berdo, P.C.

(57) ABSTRACT

The present invention relates to an LED lighting apparatus with uniform-emitting performance on a wall structure, including: a power part (10) for supplying a power source; a light source part (20) having an LED (21), a PCB (23) for mounting the LED (21) thereon, and a lens (25) located on bottom of the LED (21); an acrylic structure (30) spaced apart from the lens 25 by a given distance to pass the light emitted from the LED (21) therethrough; a fixing part (40) for fixing the power part (10), the light source part (20), and the acrylic structure (30); an aluminum body case (50) for covering the light source part (20); an aluminum fixing case (60) coupled to the aluminum body case (50) in such a manner as to be fastened to the wall structure; and a column (70) for supporting the aluminum fixing case (60) and the fixing part (40).

11 Claims, 5 Drawing Sheets

(56) References Cited

U.S. PATENT DOCUMENTS

| | | | | |
|---|---|---|---|---|
| 2013/0120974 | A1* | 5/2013 | Swisha | F21V 33/006 362/147 |
| 2014/0247603 | A1* | 9/2014 | Cruz | F21K 9/60 362/311.01 |
| 2017/0234523 | A1* | 8/2017 | Krijn | E04F 19/0436 362/145 |

* cited by examiner

LED LIGHTING APPARATUS WITH UNIFORM-EMITTING PERFORMANCE ON WALL-STRUCTURE

CROSS REFERENCE TO RELATED APPLICATION OF THE INVENTION

The present application claims the benefit of Korean Patent Application No. 10-2020-0026417 filed in the Korean Intellectual Property Office on Mar. 3, 2020 the entire contents of which are incorporated herein by reference.

BACKGROUND OF THE INVENTION

Field of the Invention

The present invention relates to a light-emitting diode (LED) lighting apparatus with uniform-emitting performance on a wall structure that is capable of forming given illuminance (Lux) so that when LED light is emitted onto the wall structure, the emitted light is most uniformly distributed in every direction on the wall structure.

In particular, the present invention relates to an LED lighting apparatus with uniform-emitting performance on a wall structure that is capable of being located on a flat structure like an outer wall or wall structure of a building to allow an LED having a given straight angle to be kept at a given distance from a transparent acrylic structure, which makes no difference in the brightness between the brightest and darkest portions of the light emitted on the outer wall or wall structure, thereby ensuring high visibility even at a long distance.

Further, the present invention relates to an LED lighting apparatus with uniform-emitting performance on a wall structure that is capable of providing an acrylic structure with a diffusion sheet attached thereto so that if the light emitted from an LED passes through a lens and the acrylic structure, sequentially, the light emitted onto the wall structure, which is at a close distance to the LED, is diffusedly distributed, and that is capable of adjusting a ratio of a diffusion acrylic plate to a transparent acrylic plate of the acrylic structure to allow the light at the longest distance from the LED to be straightly emitted and to thus keep a distance between the lens including the LED and the acrylic structure, thereby achieving the uniformity of light emission.

Furthermore, the present invention relates to an LED lighting apparatus with uniform-emitting performance on a wall structure that is capable of adjusting a distance between a lens including an LED and an acrylic structure and a distance between the lens and the wall structure, thereby achieving more beautiful light emission.

Also, the present invention relates to an LED lighting apparatus with uniform-emitting performance on a wall structure that is capable of allowing half of the acrylic structure to be composed of a diffusion acrylic plate and allowing the rest of the acrylic structure to be composed of a transparent acrylic plate according to the kind of the acrylic structure manufactured, so that the diffusion acrylic plate is located under the light at a close distance to an LED and the transparent acrylic plate is located under the light at the longest distance from the LED, thereby achieving more beautiful uniform light.

In addition, the present invention relates to an LED lighting apparatus with uniform-emitting performance on a wall structure that is capable of allowing half the acrylic structure to be composed of a diffusion acrylic plate having a diffusion sheet attached to top thereof and allowing the rest of the acrylic structure to have a transparent acrylic plate according to the kind of the acrylic structure manufactured, so that the diffusion acrylic plate is located under the light at a close distance to an LED and the transparent acrylic plate is located under the light at the longest distance from the LED, thereby achieving more beautiful uniform light.

BACKGROUND OF THE RELATED ART

Generally, as shown in FIG. 1A, an LED lighting device is configured to have arms (supports) extended long from a high and large wall structure or wall surface to symmetrically emit light onto the wall structure or surface, and up to now, many LED lighting devices have been installed in the same manner as above.

Under the above configuration, in this case, a portion close to a light source (lighting) is too bright, shades (brightness and darkness) occur due to a distance between the light sources, and light does not almost reach a bottom portion at a long distance from the light source to make the bottom portion darkened, so that many shades occur on the entire wall structure onto which the light is emitted, thereby undesirably making the uniformity of light emission deteriorated badly, that is, providing low visibility.

So as to solve the problems the conventional installation method has had, the lengths of the arms (supports) are reduced and a large number of light sources are installed through the decrease of the distance between the light sources, so that given uniformity in the light emission can be achieved. In this case, the installation cost and electric bill are undesirably raised, and in spite of the disadvantages, shades still appear on the entire wall surface.

Moreover, as shown in FIG. 1B, another LED lighting device capable of automatically adjusting illuminance is disclosed in Korean Patent Application Laid-open No. 10-2013-0054694, and the conventional LED lighting device automatically controls illuminance in specific indoor space consistently so that the illuminance is over a desired value of a person who stays therein. Through the formation of a cutoff structure in the conventional LED lighting device, however, a portion close to a light source (lighting) is too bright, shades (brightness and darkness) occur by means of a distance between the light sources, and light does not almost reach a bottom portion at a long distance from the light source to thus make the bottom portion darkened, so that undesirably, visibility becomes low on the entire wall structure onto which the light is emitted.

SUMMARY OF THE INVENTION

Accordingly, the present invention has been made in view of the above-mentioned problems occurring in the related art, and it is an object of the present invention to provide an LED lighting apparatus with uniform-emitting performance on a wall structure that is capable of providing an acrylic structure adapted to allow light to be diffusedly emitted onto a portion close to an LED and to allow the light to pass therethrough so that the light can sufficiently reach a portion at a long distance from the LED, thereby making no difference in the brightness between the brightest and darkest portions of the light emitted on the wall structure on which the LED lighting apparatus is built, without having any arms (supports).

It is another object of the present invention to provide an LED lighting apparatus with uniform-emitting performance on a wall structure that is capable of allowing an acrylic structure to be kept at a given distance from a lens including an LED and adjusting a distance between a wall surface and a light source part including the LED and the lens, as will be suggested in Table 1 showing observation distances for uniform emission, thereby providing uniform illuminance, and of course, values, which are over or under the values suggested in Table 1, may provide given uniformity.

To accomplish the above-mentioned objects, according to the present invention, there is provided an LED lighting apparatus with uniform-emitting performance on a wall structure, which allows light emitted in every direction when the light is emitted onto the wall structure to have given illuminance at which the light is most uniformly distributed onto the wall structure, the LED lighting apparatus including: a power part for supplying a power source; a light source part having an LED, a PCB for mounting the LED thereon, and a lens located on bottom of the LED; an acrylic structure spaced apart from the lens by a given distance to pass the light emitted from the LED therethrough; a fixing part for fixing the power part, the light source part, and the acrylic structure; an aluminum body case for covering the light source part; an aluminum fixing case coupled to the aluminum body case in such a manner as to be fastened to the wall structure; and a column for supporting the aluminum fixing case and the fixing part.

According to the present invention, desirably, the LED and the lens are attached to each other by means of taping, and after the lens is attached to the LED, a space between the lens and the PCB in which the LED is mounted is filled with silicone with a thickness of 1 to 2 mm.

According to the present invention, desirably, the lens having a given straight angle is kept at a given distance from the acrylic structure, the given straight angle of the lens is in the range of 8 to 16°, and the distance between the lens and the acrylic structure is in the range of 1 to 40 mm.

According to the present invention, desirably, if a height of an area onto which the light is emitted becomes high, the distance between the lens and the acrylic structure is kept to 40 mm or less; if the height becomes low, the distance between the lens and the acrylic structure is kept to 20 mm or less; if the height becomes high, a distance between the wall surface and the lens is kept to 300 mm or less; and if the height becomes low, the distance between the wall surface and the lens is kept to 200 mm or less.

BRIEF DESCRIPTION OF THE DRAWINGS

The above and other objects, features and advantages of the present invention will be apparent from the following detailed description of the embodiments of the invention in conjunction with the accompanying drawings, in which.

DETAILED DESCRIPTION OF THE EMBODIMENTS

Figure 1A:
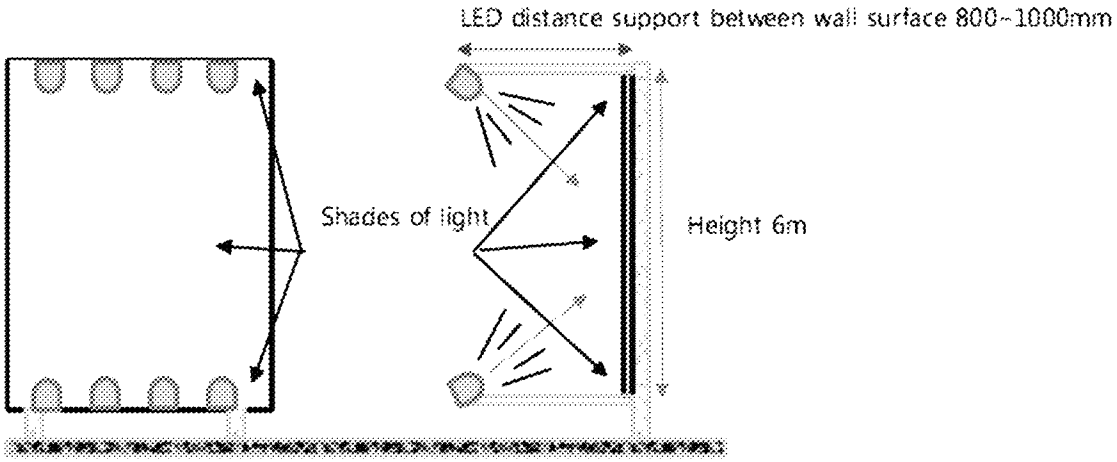
FIG. 1A Prior Art
FIGS. 1A and 1B show conventional LED lighting devices.
Figure 1B:
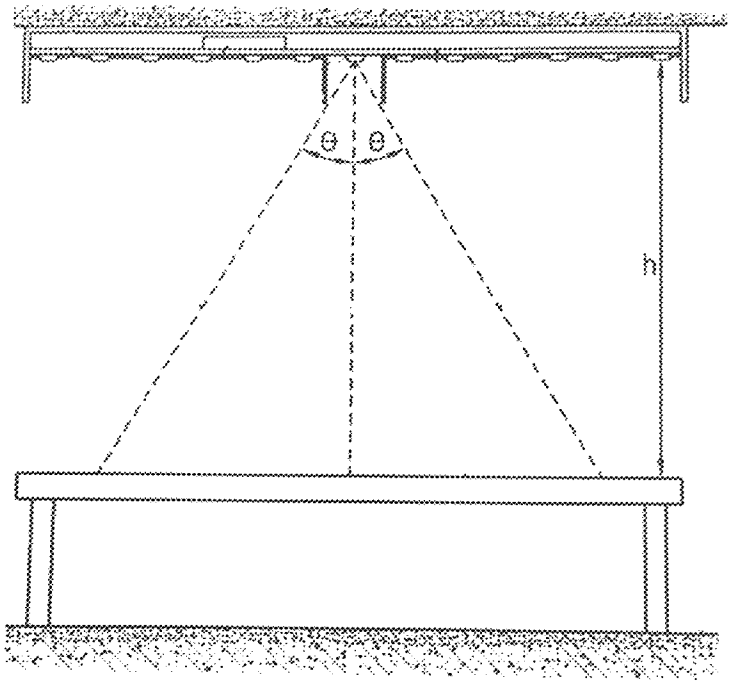
FIG. 1B Prior Art
Figure 2:
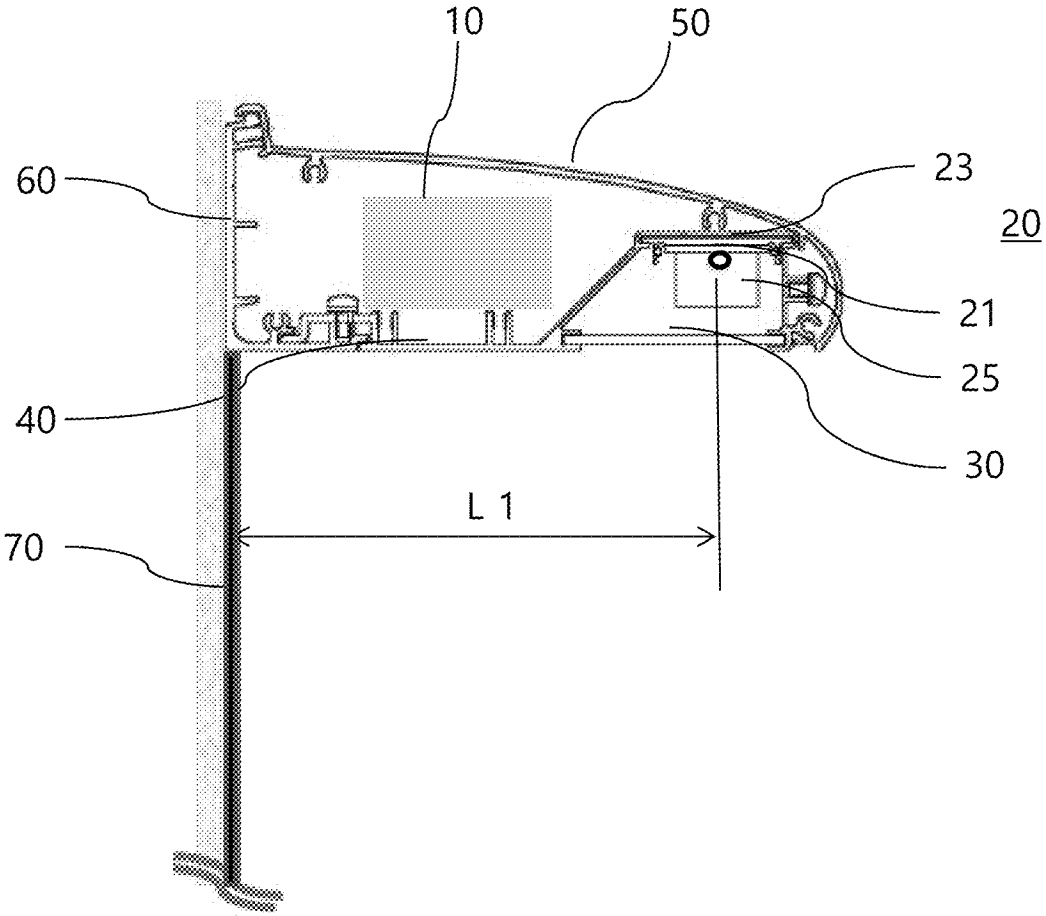
FIG. 2 is a side view showing an LED lighting apparatus according to the present invention.
Figure 4A:
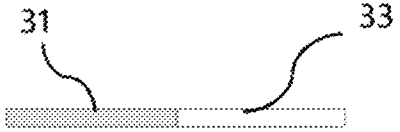
FIG. 4A is a side view showing an acrylic structure made by combining a half diffusion plate and a half transparent acrylic plate in the LED lighting apparatus according to the present invention.
Figure 4B:
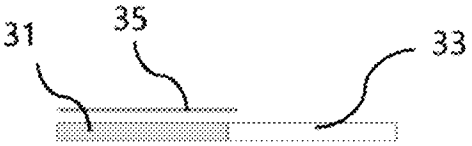
FIG. 4B is a side view showing an acrylic structure with a diffusion sheet attached to top thereof in the LED lighting apparatus according to the present invention.
Figure 4C:
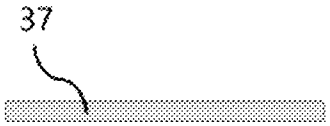
FIG. 4C is a side view showing the acrylic structure composed of an entire diffusion acrylic plate or entire diffusion extrusion plate in the LED lighting apparatus according to the present invention.
Figure 3:
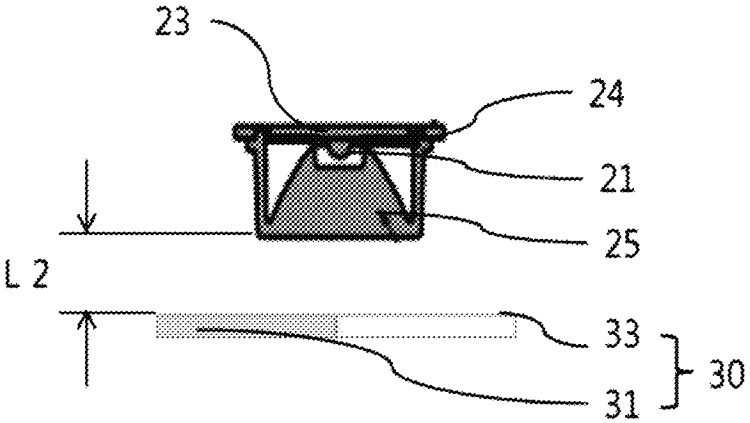
FIG. 3 is a side view showing a light source part of the LED lighting apparatus according to the present invention.
Figure 5:
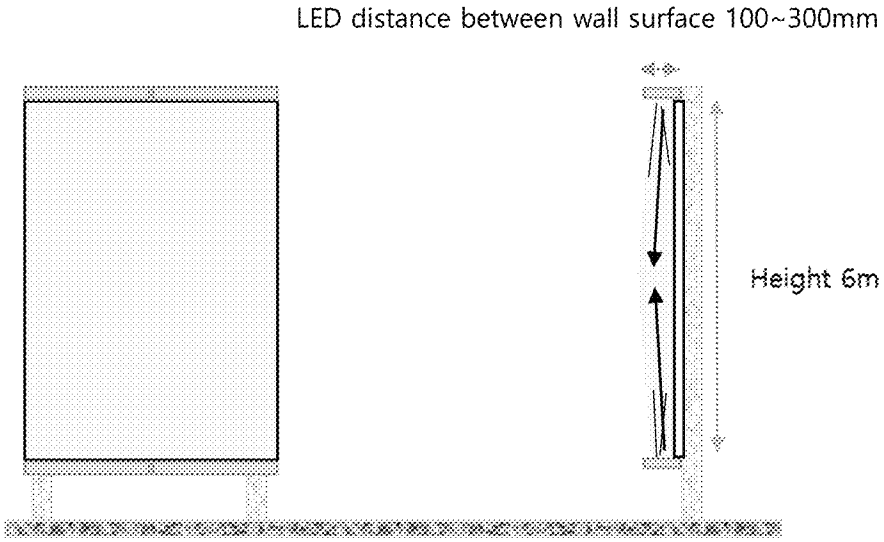
FIG. 5 is a side view showing an example where the LED lighting apparatus according to the present invention is really used.

FIGS. 2 to 5 show an LED lighting apparatus with uniform-emitting performance on a wall structure that is capable of allowing light emitted in every direction when the light is emitted onto the wall structure to have given illuminance at which the light is most uniformly distributed onto the wall structure, thereby achieving the uniform-emitting performance on the wall structure, and referring to the figures, an explanation of the technical configuration and operating effects of the present invention will be given below.

According to the present invention, the LED lighting apparatus with uniform-emitting performance on a wall structure, which allows light emitted in every direction when the light is emitted onto the wall structure to have given illuminance at which the light is most uniformly distributed onto the wall structure, includes: a power part 10 for supplying a power source; a light source part 20 having an LED 21, a printed circuit board (PCB) 23 for mounting the LED 21 thereon, and a lens 25 located on bottom of the LED 21; an acrylic structure 30 spaced apart from the lens 25 by a given distance to pass the light emitted from the LED 21 therethrough; a fixing part 40 for fixing the power part 10, the light source part 20, and the acrylic structure 30; an aluminum body case 50 for covering the light source part 20; an aluminum fixing case 60 coupled to the aluminum body case 50 in such a manner as to be fastened to a wall surface; and a column 70 for supporting the aluminum fixing case 60 and the fixing part 40.

Under the above-mentioned configuration, the LED 21 having a given straight angle is kept at a given distance from the transparent acrylic structure 30, which makes no difference in the brightness between the brightest and darkest portions of the light emitted onto the outer wall or wall structure on which the LED lighting apparatus is located, without having any arms (supports), so that if the light emitted from the LED 21 passes through the lens 25 and the acrylic structure 30, sequentially, the light emitted onto a wall surface, which is at a close distance to the LED 21, is diffused at low illuminance by means of the acrylic structure 30, and the light at the longest distance from the LED 21 is more concentratedly diffused by means of the lens 25, thereby providing the illuminance with uniform brightness even at a long distance and achieving high visibility even at the long distance.

Also, the LED lighting apparatus according to the present invention is fixed directly to the outer wall or wall structure, thereby providing a good outer appearance, and even if the LED lighting apparatus is located without any distance, the light is distributed uniformly to allow high visibility even at a long distance from the LED lighting apparatus. Unlike the conventional practices, the present invention does not need to locate several LED lighting apparatuses so as to achieve uniform light emission or does not need to locate the arms (supports) so as to make a distance from the LED lighting apparatus, so that an installation cost can be saved and more beautiful light can be provided.

According to other characteristics of the LED lighting apparatus of the present invention, the LED 21 and the lens 25 are attached to each other by means of taping, and after the lens 25 is attached to the LED 21, a space between the lens 25 and the PCB 23 in which the LED 21 is mounted is filled with silicone 24 with a thickness of 1 to 2 mm.

On the other hand, observation distances for uniform emission in the LED lighting apparatus according to the present invention are suggested in Table 1.

TABLE

Observation distances for uniform emission (unit mm/%)

| Distance division height(H) | Distance between wall surface and LED | Angles of LED and lens | Distance between lens and acrylic structure | Two kinds of acrylic structures | |
|---|---|---|---|---|---|
| | | | | Entire diffusion | Half diffusion and Half transparent |
| Type A (3 m or less) | 100~200 mm | 8~16° | 1~20 mm | 40~60% | 40~50%<br>60~70% |
| Type B (6 m or less) | 210~300 mm | 8~16° | 21~40 mm | 40~60% | 40~50%<br>60~100% |

Referring to Table 1, the lens 25 having a given straight angle is maintained at a given distance L2 from the acrylic structure 30, and in this case, the straight angle of the lens 25 is kept at an angle of 8 to 16°, while the distance L2 between the lens 25 and the acrylic structure 30 is being selectively made in the range of 1 to 40 mm, thereby improving uniform-emitting performance on the wall structure.

If the height H of an area onto which the light is emitted in the LED lighting apparatus becomes high, further, the distance L2 between the lens 25 and the acrylic structure 30 is kept to 40 mm or less, and contrarily, if the height H becomes low, the distance L2 is kept to 20 mm or less, thereby improving the uniformity of light emission.

Also, a distance L1 between the wall surface and the protruding lens 25 in the LED lighting apparatus is kept to 300 mm or less if the height H becomes high, and the distance L1 is kept to 200 mm or less if the height H becomes low. Further, if the height H becomes high, the acrylic structure 30 in the LED lighting apparatus is configured to combine a 40 to 50% diffusion acrylic structure 31 and a 60 to 100% transparent acrylic structure 33, and contrarily, if the height H becomes low, the acrylic structure 30 in the LED lighting apparatus is configured to combine a 40 to 50% diffusion acrylic structure 31 and a 60 to 70% transparent acrylic structure 33, so that the LED 21 having the given straight angle is kept at the given distance from the transparent acrylic structure 30, which makes no difference in the brightness between the brightest and darkest portions of the light emitted on the outer wall or wall structure, thereby providing high visibility even at a long distance.

Also, the LED lighting apparatus according to the present invention is fixed directly to the outer wall surface, thereby providing a good outer appearance, and even if the LED lighting apparatus is located without any distance, the light is distributed uniformly to allow high visibility even at a long distance from the LED lighting apparatus. Unlike the conventional practices, the present invention does not need to locate several LED lighting apparatuses so as to achieve uniform emission or does not need to locate the arms (supports) so as to make a distance from the LED lighting apparatus, so that an installation cost can be saved and more beautiful light can be provided.

On the other hand, the LED lighting apparatus further may include a diffusion sheet 35 attached to top of half of diffusion acrylic structure 31, and otherwise, the acrylic structure 30 may be selected from an entire diffusion acrylic structure 37 and entire diffusion extrusion plate 37 if necessary.

As set forth in the foregoing, the LED lighting apparatus according to the present invention can have a more beautiful shape because no arms (supports) exist, thereby looking like a unitary form with the wall structure, and further, the LED lighting apparatus can be easily installed, thereby reducing an installation cost.

Furthermore, the LED lighting apparatus according to the present invention can provide excellent light emission uniformity even with a slim structure for uniformly emitting light onto the wall surface or structure, without having general arms (supports), so that the LED lighting apparatus can be made to a reliable shape, can look like a unitary form with the wall surface or structure, and can be easily installed to thus reduce an installation cost.

Also, the LED lighting apparatus according to the present invention can have no shades on the wall surface or structure even if a large number of LED lighting apparatuses are not installed, thereby achieving the reduction of manufacturing and installation costs and the conveniences of installation.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. An LED lighting apparatus with uniform-emitting performance on a wall structure, which allows light emitted in every direction when the light is emitted onto the wall structure to have given illuminance at which the light is most uniformly distributed onto the wall structure, the LED lighting apparatus comprising:

a power source;

a light source part (20) having an LED (21), a PCB (23) for mounting the LED (21) thereon, and a lens (25) located on a bottom of the LED (21);

an acrylic structure (30) spaced apart from the lens (25) by a given distance to pass the light emitted from the LED (21) therethrough;

a support structure (40) onto which the power source, the light (20), and the acrylic structure (30) are all mounted;

an aluminum body case (50) for covering the light (20);

an aluminum fixing case (60) coupled to the aluminum body case (50) in such a manner as to be fastened to the wall structure; and a column (70) for supporting the aluminum fixing case (60) and the support structure (40).

2. The LED lighting apparatus according to claim 1, wherein the LED (21) and the lens (25) are attached to each other, and after the lens (25) is attached to the LED (21), a space between the lens (25) and the PCB (23) in which the LED (21) is mounted is filled with silicone (24) with a thickness of 1 to 2 mm.

3. The LED lighting apparatus according to claim 1, wherein the lens (25) has a given straight angle and is kept at a given distance (L2) from the acrylic structure (30).

4. The LED lighting apparatus according to claim 1, wherein a given straight angle of the lens (25) is in a range of 8 to 16°.

5. The LED lighting apparatus according to claim 1, wherein a distance (L2) between the lens (25) and the acrylic structure (30) is in a range of 1 to 40 mm.

6. The LED lighting apparatus according to claim 1, wherein if a height (H) of an area onto which the light is emitted becomes high, a distance (L2) between the lens (25) and the acrylic structure (30) is kept to 40 mm or less, and if the height (H) becomes low, the distance (L2) between the lens (25) and the acrylic structure (30) is kept to 20 mm or less.

7. The LED lighting apparatus according to claim 1, wherein a distance (L1) between the wall structure and the lens (25) is kept to 300 mm or less if a height (H) of an area onto which the light is emitted becomes high, and the distance (L1) is kept to 200 mm or less if the height (H) becomes low.

8. The LED lighting apparatus according to claim 1, wherein if a height (H) of an area onto which the light is emitted becomes high, the acrylic structure (30) comprises a 40 to 50% diffusion acrylic structure (31) and a 60 to 100% transparent acrylic structure (33).

9. The LED lighting apparatus according to claim 1, wherein if a height (H) of an area onto which the light is emitted becomes low, the acrylic structure (30) comprises a 40 to 50% diffusion acrylic structure (31) and a 60 to 70% transparent acrylic structure (33).

10. The LED lighting apparatus according to claim 8, wherein the acrylic structure (30) comprises a diffusion sheet (35) attached to a top of half thereof.

11. The LED lighting apparatus according to claim 8, wherein the acrylic structure (30) is comprises entirely of a single diffusion structure selected from an entire diffusion acrylic structure (37) and an entire diffusion extrusion plate (37).

* * * * *